United States Patent [19]

Rinehart

[11] 4,428,154

[45] Jan. 31, 1984

[54] WINDOW SAFETY LOCK

[75] Inventor: David M. Rinehart, Selma, Ala.

[73] Assignee: DISCO Aluminum Products Company, Inc., Selma, Ala.

[21] Appl. No.: 383,577

[22] Filed: Jun. 1, 1982

[51] Int. Cl.[3] ..... E05D 15/00

[52] U.S. Cl. ..... 49/390; 49/394; 292/276; 292/277

[58] Field of Search ..... 49/390, 394; 292/376, 292/377

[56] References Cited

U.S. PATENT DOCUMENTS

| | | | |
|---|---|---|---|
| 2,714,033 | 7/1955 | Lewgowd | 292/276 X |
| 4,080,758 | 3/1978 | Habbard | 49/394 X |
| 4,307,542 | 12/1981 | Lense | 49/390 X |

FOREIGN PATENT DOCUMENTS

| | | | |
|---|---|---|---|
| 2512308 | 9/1975 | Fed. Rep. of Germany | 292/276 |

*Primary Examiner*—Kenneth Downey

*Attorney, Agent, or Firm*—Woodford R. Thompson, Jr.

[57] ABSTRACT

A safety lock for a window mounted for pivotal movement about a centrally disposed vertical axis embodies a lock assembly housing mounted on the window sill intermediate the vertical axis and a window jamb. An elongated vertically extending locking member mounted on the lock assembly housing is movable selectively to a locked position with its upper end adjacent the housing and to an unlocked position with its upper end spaced from the housing. A latch assembly housing is mounted on the lower portion of the window intermediate the vertical axis and a vertical side frame member. A connector arm is pivotally connected at one end to a lower portion of the latch assembly housing with its other end engaging the locking member to permit pivotal movement of the window selectively to a closed position and to a limited open position. The locking member is moved to its unlocked position by a release element which permits the connector arm to be disengaged from the locking member and permits the window to pivot toward a reversed position.

14 Claims, 21 Drawing Figures

Fig. 7
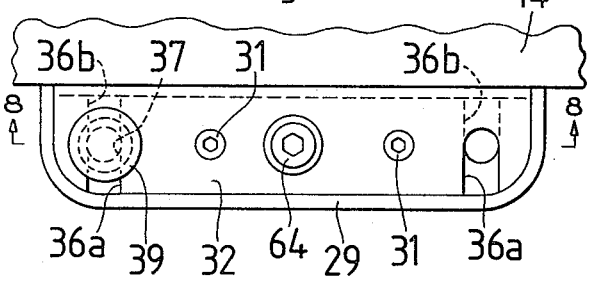
Fig. 8
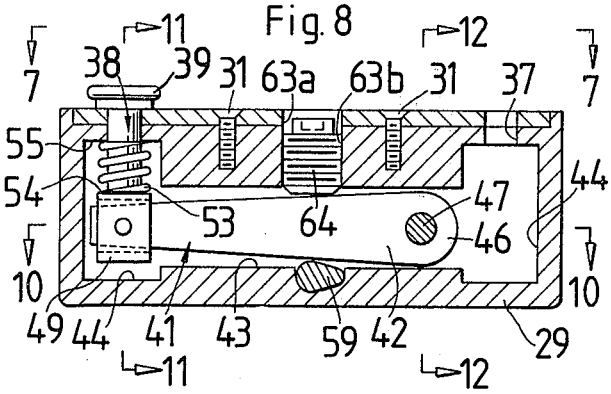
Fig. 10
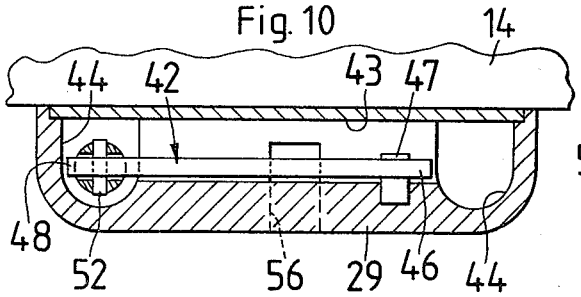
Fig. 9
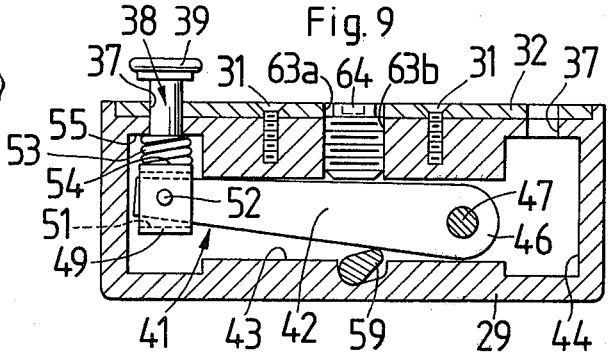
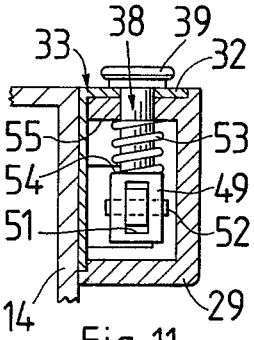
Fig. 11
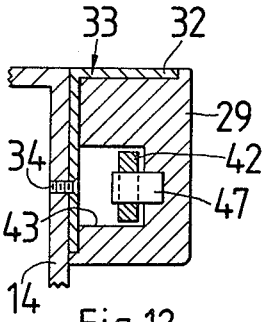
Fig. 12
Fig. 13
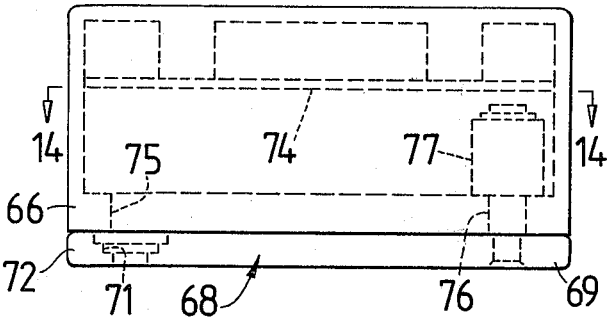
Fig. 14
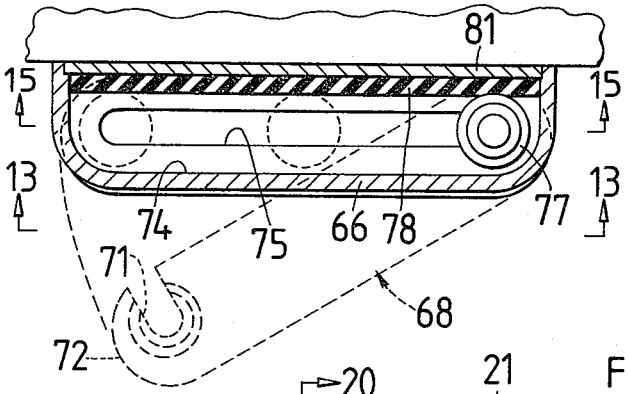
Fig. 15
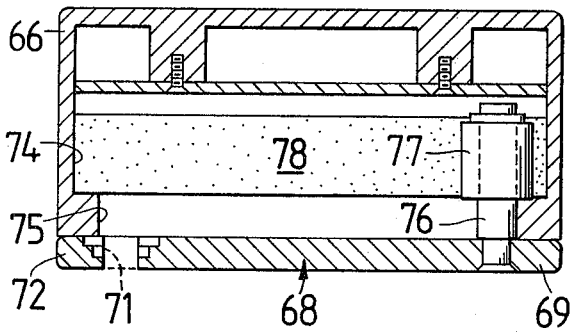
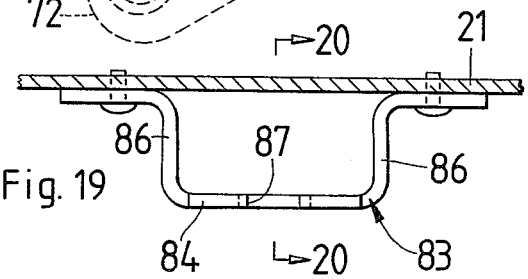
Fig. 19
Fig. 20
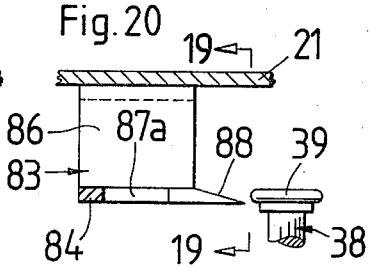
Fig. 21
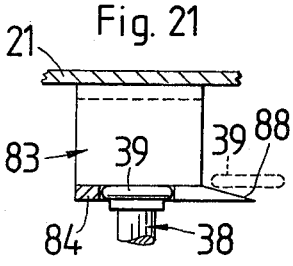

WINDOW SAFETY LOCK

BACKGROUND OF THE INVENTION

This invention relates to a safety lock for a window mounted for pivotal movement about a centrally disposed vertical axis and more particularly to an improved safety lock which positively limits pivotal movement of the window beyond a limited open ventilating position.

Heretofore in the art to which my invention relates, most windows installed in multi-story commercial buildings, high rise apartments and the like were fixed windows which were built from large panels of safety glass. This type window provided excellent protection against the weather and high wind loads. It also prevented tenants and other occupants of the building from accidently falling through the window. However, due to increasing power failures, air conditioning breakdowns and the like, it has become necessary to install windows in such buildings which may be opened to at least a limited open emergency ventilating position without the use of special tools or keys. Such limited opening windows are usually constructed from window sashes mounted for pivotal movement about a centrally disposed vertical axis.

In most emergency situations, the person opening a pivotally mounted window is usually unfamiliar with the safety lock mounted thereon and uses excessive force to open the window. This could result in the window being opened very rapidly to a position which could possibly permit the person to fall through the window.

U.S. Pat. No. 4,080,758 discloses an intricate and complicated safety lock which is adapted to restrain pivotal movement of such a window beyond the limited open position. This safety lock utilizes a pivot arm which has a control cam eccentrically mounted at one end thereof in position to engage a leaf spring and hold the window in the limited open ventilating position. That is, the force exerted by the leaf spring against the control cam limits horizontal pivotal movement of the pivot arm, which in turn, limits movement of the window beyond the limited open position. If the window has been opened a considerable number of times or exposed to high wind loads which attempt to pivot the window beyond the limited open position, a person pushing or accidentally falling against the window could overcome the force exerted by the leaf spring and cause the window to be disengaged from the pivot arm. This would expose the person to the danger of falling through the open window. Accordingly, this safety lock provides no positive means to prevent the pivot arm from disengaging the window sash while in the limited open position.

SUMMARY OF THE INVENTION

In accordance with my present invention, I overcome the above and other difficulties by providing an improved safety lock for use with a window mounted for pivotal movement about a centrally disposed vertical axis which is simple of construction and economical of manufacture.

An object of my invention is to provide an improved safety lock which permits such a window to be easily and safely opened to a limited open ventilating position without the use of special tools or keys.

Another object of my invention is to provide a safety lock which positively limits movement of the window beyond the limited open position except where a controlled key or special tool is used to release the safety lock.

A further object of my invention is to provide a safety lock which permits such a window to be pivoted and retained in an approximate 180° or reversed position whereby the outer surface of the window faces the inside of the building.

My improved safety lock for a window mounted for pivotal movement about a centrally disposed vertical axis comprises a lock assembly housing mounted on the window sill intermediate the vertical axis and one jamb of the window opening. An elongated, vertically extending locking member is mounted for vertical movement relative to the lock assembly housing selectively to a locked position with its upper end adjacent an upper portion of the housing and to an unlocked position with its upper end spaced from the housing. A latch assembly housing is mounted on the lower portion of the window intermediate the vertical axis and a vertical side frame member. An elongated, horizontal connector arm is pivotally connected at one end to a lower portion of the latch assembly housing with its other end engaging the locking member to permit pivotal movement of the window relative to the window opening selectively to a closed position and to a limited open position. A stop member carried by the lock assembly housing prevents disengagement of the connector arm from the locking member and positively limits pivotal movement of the window beyond the limited open position. A key-like release element moves the locking member toward its unlocked position to disengage the connector arm from the locking member and permit free pivotal movement of the window out of the limited open position toward an approximate 180° or reversed position.

DESCRIPTION OF THE DRAWINGS

Apparatus embodying features of my invention is illustrated in the accompanying drawings, forming a part of this application, in which:

FIG. 7 is a top plan view of the lock assembly housing taken generally along the line 7—7 of FIG. 8;

FIG. 8 is a vertical sectional view taken generally along the line 8—8 of FIG. 7 showing the locking member in its locked position;

FIG. 9 is a vertical sectional view corresponding to FIG. 8 showing the locking member in its unlocked position;

FIG. 10 is a horizontal sectional view taken generally along the line 10—10 of FIG. 8;

FIG. 11 is a vertical sectional view taken generally along the line 11—11 of FIG. 8;

FIG. 12 is a vertical sectional view taken generally along the line 12—12 of FIG. 8;

FIG. 13 is a side elevational view showing the latch assembly housing and taken generally along the line 13—13 of FIG. 14;

FIG. 14 is a horizontal sectional view taken generally along the line 14—14 of FIG. 13;

FIG. 15 is a vertical sectional view taken generally along the line 15—15 of FIG. 14;

FIG. 19 is an elevational view, partly in section, taken generally along the line 19—19 of FIG. 20;

FIG. 20 is a sectional view taken generally along the line 20—20 of FIG. 19; and FIG. 21 is a sectional view corresponding to FIG. 20 showing the locking member in engagement with the locking clip.

DETAILED DESCRIPTION

Figure 1:
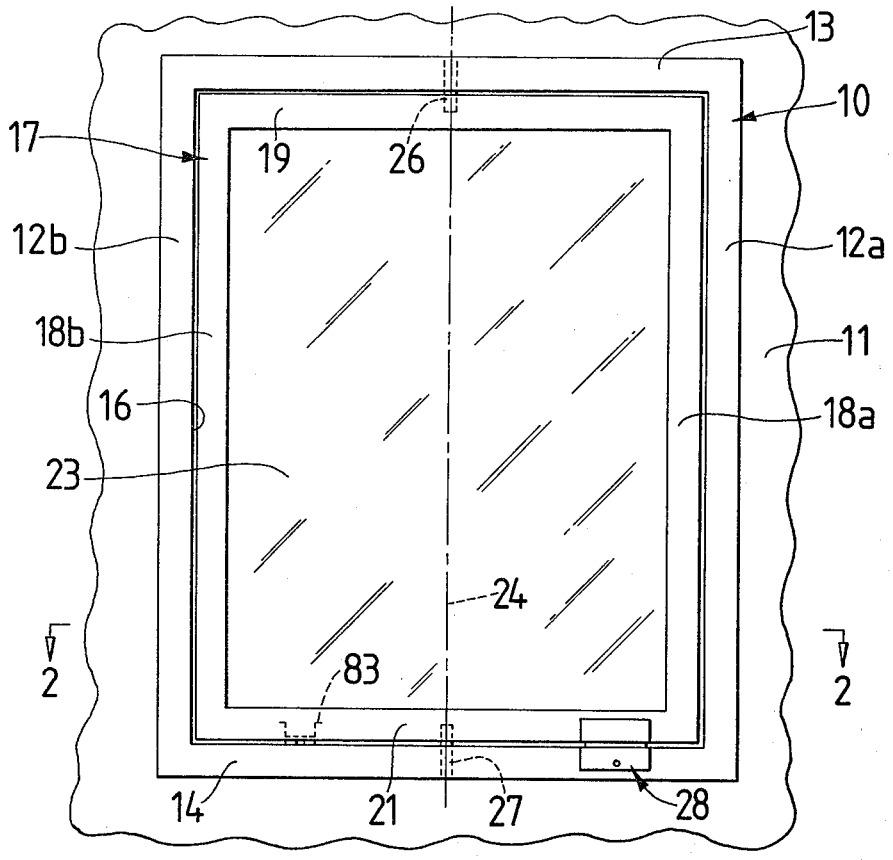
FIG. 1 is an elevational view showing a window unit with the sash mounted for pivotal movement about a centrally disposed vertical axis and showing the sash in a closed position relative to the sash opening.
Figure 2:
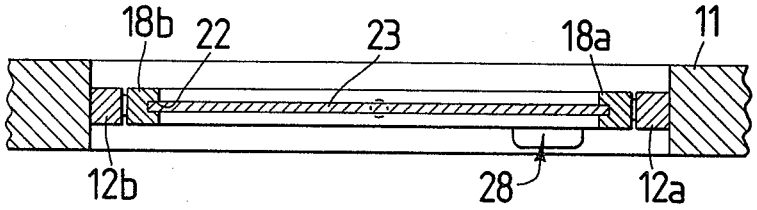
FIG. 2 is a horizontal sectional view taken generally along the line 2—2 of FIG. 1.
Figure 5:
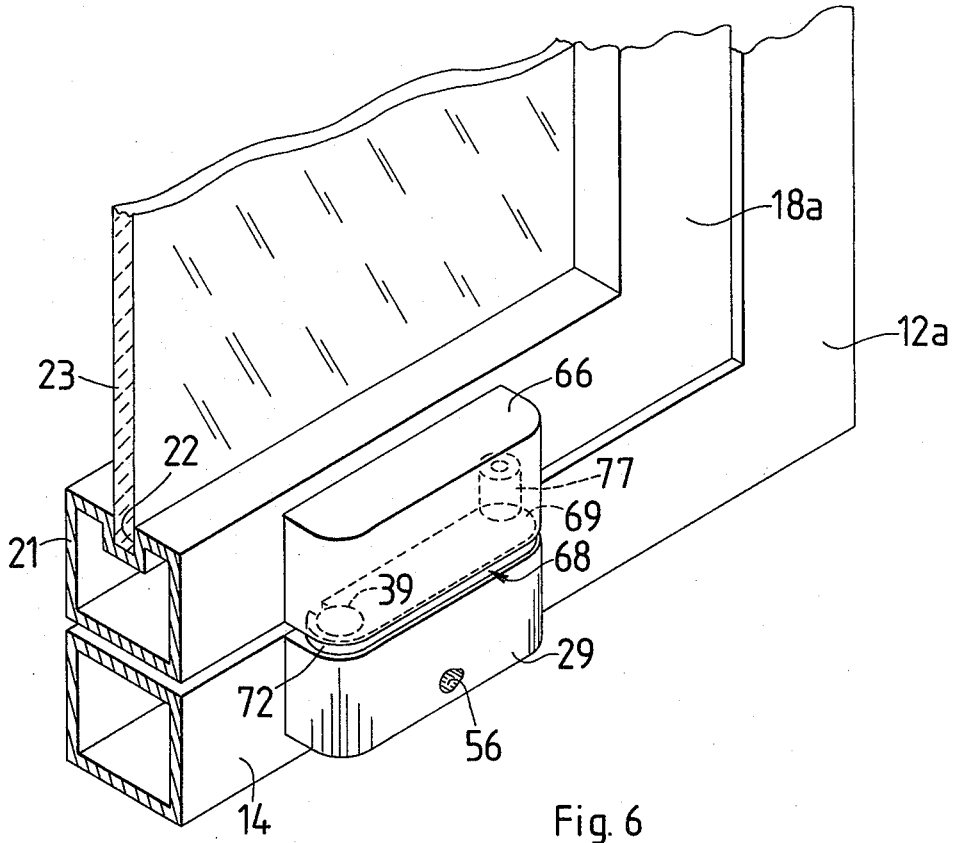
FIG. 5 is an enlarged, fragmental perspective view showing my improved safety lock mounted on the lower portion of the sash and window sill.
Figure 6:
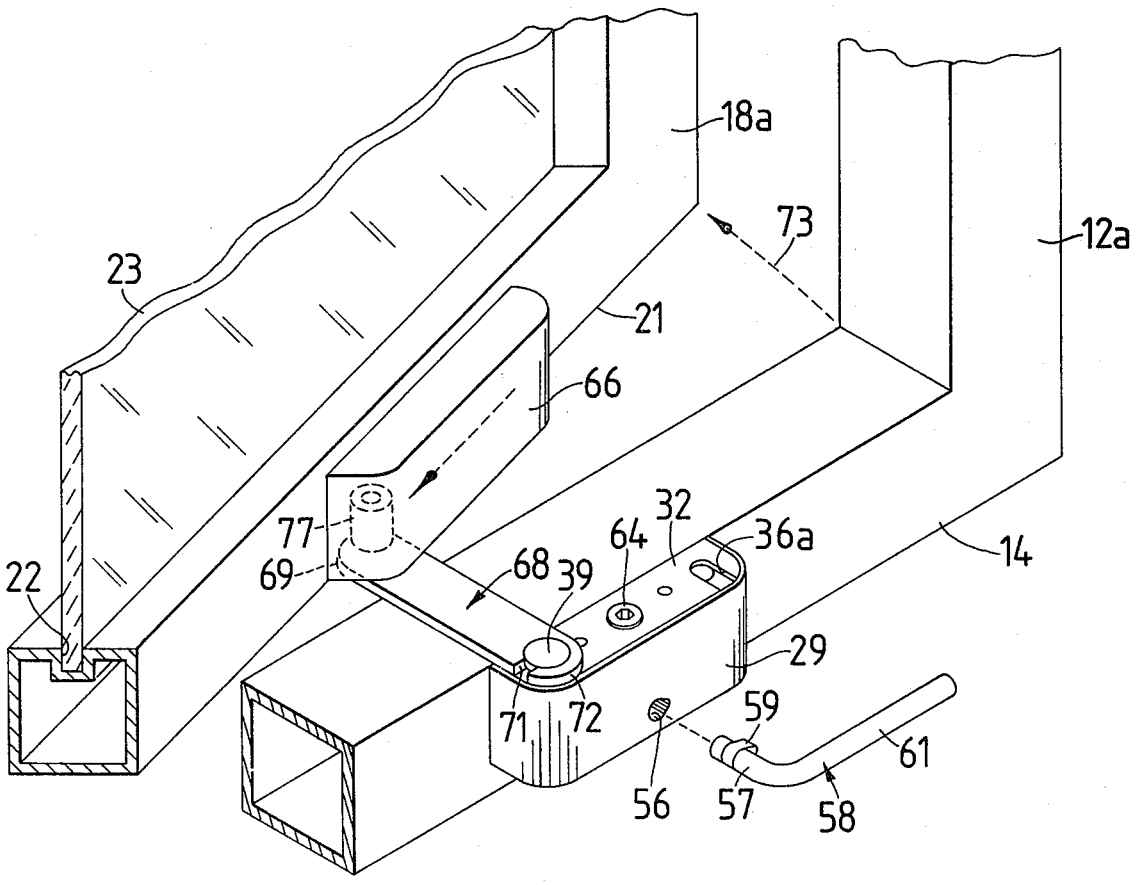
FIG. 6 is a fragmental perspective view corresponding to FIG. 5 showing the position of the connector arm when the sash is in the limited open position.

Referring now to the drawings for a better understanding of my invention, I show in FIG. 1 a window frame 10 mounted in a rectangular opening in a wall of a building structure, indicated generally at 11. The window frame includes a pair of spaced apart vertical side frame members or jambs $12^a$ and $12^b$, a horizontal upper frame member or header 13 and a horizontal lower frame member or sill 14. The window frame 10 defines a rectangular sash opening 16 in which is mounted a rectangular window sash 17. The sash 17 is framed in a pair of vertical sash frame members or stiles $18^a$ and $18^b$ which are connected at their upper ends by a horizontal sash frame member 19 and at their lower ends by a horizontal sash frame member 21. An elongated channel-like recess 22 is provided in each of the stiles $18^a$ and $18^b$ and the horizontal frame members 19 and 21 for receiving a side edge portion of a glass panel 23, as shown in FIGS. 5 and 6.

The sash 17 is supported in the window frame 10 for pivotal movement about a centrally disposed vertical axis 24 by upper and lower pivot assemblies 26 and 27, respectively. The upper pivot assembly 26 interconnects the upper horizontal sash frame member 19 to the upper frame member 13 while the lower pivot assembly 27 interconnects the lower horizontal sash frame member 21 to the lower horizontal frame member 14. In view of the fact that such pivot assemblies are well known in the art to which my invention relates, no further description thereof is deemed necessary.

In accordance with my invention, I provide a window safety lock, indicated generally at 28, which is mounted on the window sill 14 and the lower sash frame member 21 intermediate the vertical axis 24 and the jamb $12^a$, as shown in FIG. 1. The safety lock 28 includes an elongated horizontal lock assembly housing 29 which is secured by suitable fasteners 31 to a horizontal leg 32 of an inverted L-shaped mounting bracket 33, as shown in FIGS. 8 and 9. The L-shaped bracket 33 is secured to the window sill 14 with suitable fasteners 34, as shown in FIG. 12.

At least one outwardly opening generally U-shaped slot $36^a$ is provided in the horizontal leg 32 of the L-shaped bracket 33 in vertical alignment with an outwardly opening U-shaped slot $36^b$ in the upper surface of the housing 29, as shown in FIG. 7. These slots when aligned vertically with each other define an opening 37 which slidably receives an elongated, vertical pin-like locking member 38 having an enlarged diameter upper end portion 39, as shown in FIGS. 8, 9 and 11.

Mounted within the lock housing 29 is a lock assembly, indicated generally at 41, which is operatively connected to a lower portion of the pin-like member 38, as shown in FIGS. 8–11. The lock assembly 41 includes an elongated bar-like arm member 42 which is mounted for pivotal movement within an elongated horizontal passageway 43 provided in the lock housing 29. The ends of the passageway 43 terminate in enlarged recesses 44 which are vertically aligned with the openings 37 defined by the U-shaped slots $36^a$ and $36^b$. As shown in FIGS. 8 and 9, the elongated arm member 42 is pivotally connected at one end 46 by a pin 47, to a side wall of the lock assembly housing 29, while its other end 48 is operatively connected to the lower portion of the pin-like member 38. That is, an enlarged member 49, having a rectangular slot 51 therethrough, is provided at the lower end of the pin-like member 38 for receiving the end 48 of the elongated arm member 42, as shown in FIGS. 8, 9 and 11. A pin 52 pivotally connects the end 48 of the elongated arm 42 to the member 49, as shown.

A resilient member, such as a compression spring 53, surrounds the pin-like member 38 between a shoulder 54, defined by the member 49, and the upper surface 55 of the enlarged recess 44, as shown in FIGS. 8, 9 and 11. The spring 53 urges the pin-like member 38 downwardly toward a locked position with its enlarged diameter upper end portion 39 engaging the horizontal leg 32 of the L-shaped bracket 33, as shown in FIG. 8.

A laterally extending, horizontal passageway 56 extends transversely from the mid-portion of the passageway 43, as shown in FIG. 10. The passageway 56 is adapted to receive one leg 57 of a generally L-shaped, rotatable key-like release element 58, as shown in FIG. 6. A laterally projecting lug 59 is carried by the leg 57 in position to extend through the passageway 56 to a position beneath the elongated arm 42, as shown in FIG. 8. Upon rotation of the other leg 61 of the L-shaped key-like element 58 in a counterclockwise direction, as shown by the dot-dash arrow 62 in FIG. 16, the lug 59 engages the elongated arm 42 and pivots its end 48 in an upward direction, as shown in FIG. 9. The upward movement of the end 48 compresses the spring 53 and moves the pin-like member 38 toward a raised or unlocked position with its upper end portion 39 spaced from the horizontal leg 32 of the L-shaped bracket 33, as shown. When the key-like element 58 is rotated in a clockwise or in a reverse direction, the force exerted by the compressed spring 53 against the shoulder 54 urges the end 48 of the elongated arm member 42 and the pin-like member 38 in a downward direction, toward its locked position and in engagement with the horizontal leg 32 of the L-shaped bracket 33, as shown in FIG. 8. The spring 53 will hold the pin-like member 38 in its locked position until it is intentionally moved upwardly by rotation of the key-like element 58 in the direction indicated by the arrow 62.

As shown in FIGS. 8 and 9, a vertically extending threaded opening 63$^a$ is provided in the horizontal leg 32 of the L-shaped bracket 33 in vertical alignment with a threaded opening 63$^b$ in the lock assembly housing 29 for receiving a threaded stop member 64. The openings 63$^a$ and 63$^b$ are vertically aligned with the horizontal passageway 43 so that upon rotation of the stop member 64 in one direction it moves into engagement with the upper surface of the elongated arm 42. In this position, the stop member 64 limits upward movement of the elongated arm 42, which in turn positively retains the locking member 38 in its locked position, as shown in FIG. 8. Rotation of the threaded stop member 64 in a reverse direction moves it out of engagement with the elongated arm 42, as shown in FIG. 9. This permits the end 48 of the elongated arm 42 to be pivoted by the key-like element 58 in an upward direction, which in turn moves the pin-like member 38 upwardly toward its unlocked position.

Figure 3:
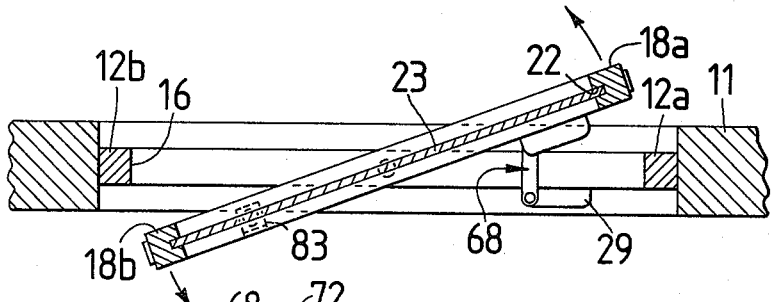
FIG. 3 is a horizontal sectional view corresponding to FIG. 2 showing the sash pivoted to a limited open ventilating position.

As shown in FIGS. 1, 5 and 6 an elongated, horizontal latch assembly housing 66 is carried by the lower sash frame member 21 between the vertical axis 24 and the stile 18$^a$. An elongated, horizontal connector arm 68 is operatively connected at one end 69 to a lower portion of the latch assembly housing 66 for pivotal and rectilinear movement in a horizontal plane subjacent the housing 66, as shown. That is, the horizontal connector arm 68 is adapted for movement relative to the latch assembly housing 66 to a first position whereby it extends longitudinally beneath the housing 66 while the sash 17 is in a closed position, as shown in dotted lines in FIG. 5. The connector arm 68 also moves to a second position whereby it projects laterally and outwardly from the housing 66 in response to movement of the sash 17 to a limited open position, as shown in FIGS. 3 and 6. As the connector arm 68 is moved from its first position to its second position, its end 69 moves in a rectilinear direction from a location beneath one end of the housing 66 to a location beneath the opposite end thereof, as shown.

A laterally opening recess 71 is provided in the other end 72 of the connector arm 68 for detachably connecting the pin-like locking member 38 to the connector arm 68 while the arm is in the first and second positions. That is, when the connector arm 68 is in the first position the recess 71 engages the upper end portion 39 of the pin-like member 38 while it is in its locked position and permits the sash 17 to pivot to the closed position relative to the sash opening 16, as shown in FIG. 5. When the sash 17 is pivoted in the direction indicated by the arrow 73 to the limited open ventilating position, the connector arm 68 moves to its second position, as shown in FIG. 6. In both of the first and second positions the stop member 64 is in engagement with the elongated arm 42, which in turn positively holds the pin-like member 38 in its locked position and prevents the connector arm 68 from disengaging the upper end portion 39 of the pin-like member 38. This arrangement positively limits pivotal movement of the sash 17 beyond the limited open position except when the key-like element 58 moves the pin-like locking member 38 upwardly toward its unlocked position to permit disengagement of the connector arm 68 from the locking member.

As shown in FIG. 15, an elongated horizontal cavity 74 is provided in the latch assembly housing 66 above an elongated slot 75 provided therein. The slot 75 and cavity 74 are adapted to receive a vertical pin-like member 76 which is carried by and extends upwardly from the end 69 of the connector arm 68. A roller 77 is mounted for rotation on the upper end of the pin-like member 76 and moves from one end of the elongated horizontal cavity 74 to the other end thereof in response to movement of the connector arm 68 to its first and second positions, as described above and shown in FIGS. 5 and 6.

An elongated resilient member, such as a neoprene pad-like member 78, extends horizontally across the full length of the cavity 74 and is secured by suitable means to the rear wall 81 of the housing 66, as shown in FIG. 14. The pad-like member 78 projects outwardly from the rear wall 81 into the path of travel of the roller 77 to restrain movement of the roller relative to the elongated cavity 74.

Figure 4:
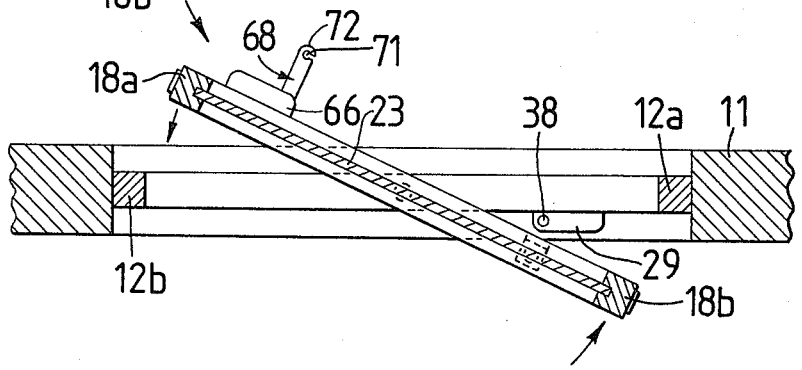
FIG. 4 is a horizontal sectional view corresponding to FIG. 2 showing the sash pivoted to an approximate 180° or reversed position.

A generally U-shaped locking clip 83, having a base 84 and upstanding legs 86, is secured to the lower sash frame member 21 between the vertical axis 24 and the stile 18$^b$, as shown in FIGS. 1, 4, 17 and 18. A laterally opening slot 87, having an enlarged diameter recess 87$^a$ at its closed end is provided in the base 84 in position to engage the upper end portion 39 of the pin-like member 38 as the sash 17 is pivoted from the limited open position toward the approximate 180° or reversed position, as shown in FIG. 4. That is, upon pivotal movement of the sash 17 to the approximate 180° or reversed position, sloping surfaces 88 on the side of the base 84 adjacent the open end of the slot 87 engage the upper end portion 39 of the pin-like member 38, as shown in FIG. 21. Further pivotal movement of the sash 17 toward the reversed position causes relative movement between the upper end portion 39 and the sloping surfaces 88 whereby the end portion 39 drops into the recess 87$^a$, as shown. This arrangement holds the sash in the reversed position to facilitate washing of the outer surface of the window from the inside of the building.

Figure 16:
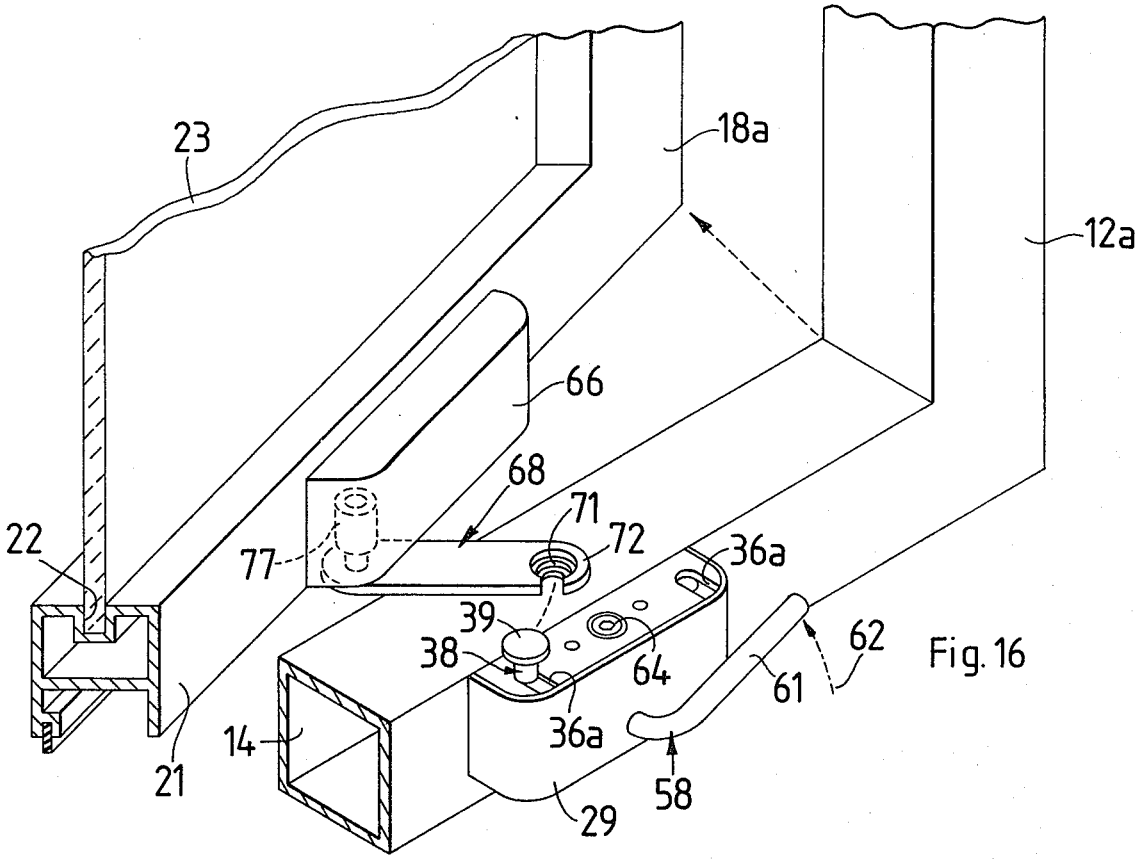
FIG. 16 is a fragmental, perspective view corresponding to FIG. 6 showing the connector arm disengaged from the locking member.
Figure 17:
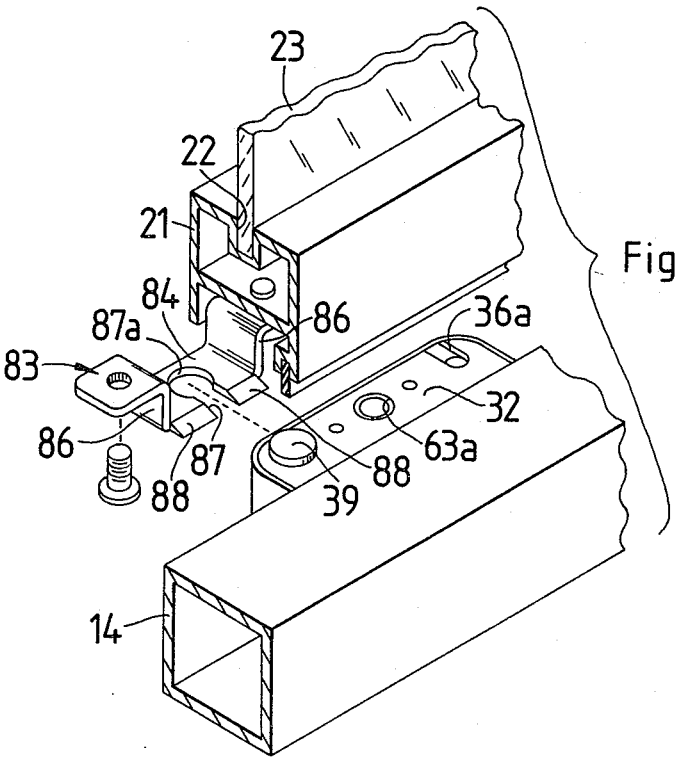
FIG. 17 is a fragmental perspective view showing a locking clip carried by the lower portion of the sash in position to engage the locking member when pivoted to the 180° or reversed position.
Figure 18:
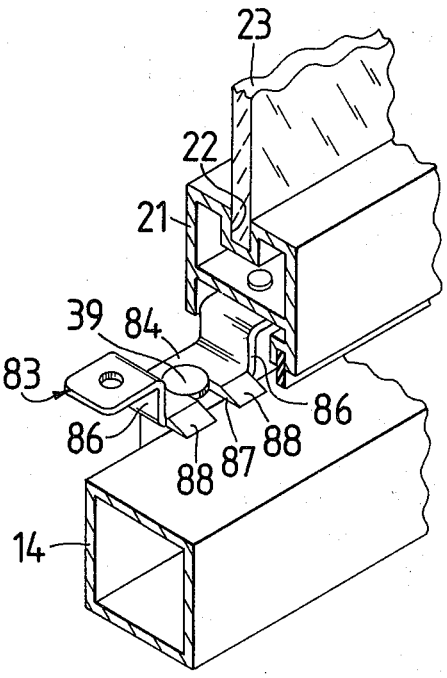
FIG. 18 is a fragmental perspective view corresponding to FIG. 17 showing the locking clip in engagement with the locking member.

To pivot the sash 17 from the 180° or reversed position back to the limited open position or to the closed position, the key-like element 58 must be rotated in the direction of the arrow 62 in FIG. 16 to raise the pin-like member 38 to its unlocked position. This disengages the upper end portion 39 of the pin-like member 38 from the recess 87$^a$ and permits the sash 17 to pivot back toward the limited open or closed positions.

From the foregoing description, the operation of my improved safety lock for a window mounted for pivotal movement about a centrally disposed vertical axis will be readily understood. When the sash 17 is in the closed position, the end 72 of the connector arm 68 is positively connected to the pin-like member 38 and the roller 77 is located on the right-hand side of the latch assembly housing 66, as shown in dotted lines in FIG. 5. To pivot the sash 17 to the limited open position, the stile 18$^a$ is moved in the direction of arrow 73 in FIG. 6. This moves the roller 77 to the left-hand side of the latch assembly housing 66, as viewed in FIG. 6, and pivots the connector arm 68 about the pin-like member 38 to its second position. In both the closed position and the limited open position, the end 72 of the connector arm 68 is maintained in positive engagement with the pin-like member 38 by the threaded stop member 64.

To pivot the sash 17 toward the approximate 180° or reversed position, the stop member 64 is rotated in the reverse direction whereby it is moved out of engagement with the elongated arm 42. This permits the key-like element 58 to pivot the end 48 of the elongated arm 42 in an upward direction whereby the spring 53 is compressed and the pin-like member 38 is moved to its upper, unlocked position. The end 72 of the connector arm 68 is then disengaged from the upper end portion 39 of the pin-like member 38 which permits the sash 17 to be pivoted toward the 180° or reversed position.

When the sash 17 is pivoted to the reversed position, the slot 87 in the base 84 of the U-shaped locking clip 83 engages the upper end portion 39 of the pin-like member 38 and holds the sash in the reversed position as described above. To pivot the sash 17 back toward the limited open position or the closed position, the key-like element 58 is rotated in the direction of the arrow 62, which in turn moves the pin-like member 38 to its unlocked position. This raises its upper end portion 39 out of engagement with the enlarged diameter recess 87$^a$ and permits the slot 87 to disengage the pin-like member 38. The sash 17 may then be pivoted back to the limited open position whereby the end 72 of the connector arm 68 may be connected to the pin-like member 38. The stop member 64 is then moved into engagement with the elongated arm 42 to maintain the connector arm 68 in positive engagement with the locking member 38. The sash 17 may then be pivoted back to the closed position, as shown in FIG. 1.

From the foregoing, it will be seen that I have devised an improved safety lock for a window mounted for pivotal movement which may be easily opened to a limited open emergency ventilating position without the use of special tools or keys. By providing stop means which positively retains the connector arm in engagement with the locking member while the sash is in the limited open position, I eliminate the possibility of the window opening accidentally whereby a person may fall therethrough. Furthermore, by providing a locking clip which engages the locking member and holds the sash in a 180° or reversed position, I provide safe and reliable means which permits the outer surface of the window to be washed quickly and easily from the inside of the building.

While I have shown my invention in but one form, it will be obvious to those skilled in the art that it is not so limited, but is susceptible of various changes and modifications without departing from the spirit thereof.

What I claim is:

1. A safety lock for a window unit having a sash mounted for pivotal movement about a centrally disposed vertical axis within a sash opening defined by horizontal upper and lower frame members and spaced apart vertical side frame members, (a) an elongated, horizontal lock assembly housing mounted on the lower frame member intermediate said vertical axis and one of said side frame members with an elongated, vertically extending locking member mounted for vertical movement relative to said housing selectively to an unlocked position with an upper portion of said locking member being spaced from the upper surface of said housing and to a locked position with said upper portion being adjacent said upper surface of said housing, (b) a lock assembly within said lock assembly housing operatively connected to a lower portion of said locking member, (c) an elongated, horizontal latch assembly housing carried by a lower portion of said sash intermediate said vertical axis and said one of said side frame members, (d) an elongated, horizontal connector arm pivotally connected at one end to a lower portion of said latch assembly housing with its other end engaging said locking member to permit pivotal movement of said sash relative to said sash opening selectively to a closed position and to a limited open position, (e) stop means carried by said lock assembly housing and engaging said lock assembly to positively retain said other end of said connector arm in engagement with said locking member while said sash is in said closed position and in said limited open position, (f) a release element having a portion thereof adapted to engage said lock assembly and move said locking member toward its unlocked position to permit said other end of said connector arm to engage and disengage said locking member so that said sash is adapted for free pivotal movement beyond said limited open position while said locking member is disengaged, and (g) resilient means within said lock assembly housing urging said locking member toward its locked position.

2. A safety lock for a window unit as defined in claim 1 in which a locking clip having an outwardly opening recess is carried by said lower portion of said sash intermediate said vertical axis and the other of said side frame members in position to engage said locking member upon pivotal movement of said sash an angular distance to position said locking clip in engagement with said locking member.

3. A safety lock for a window unit as defined in claim 2 in which said sash is adapted for free pivotal movement back toward said limited open position and said closed position upon disengagement of said locking clip from said locking member.

4. A safety lock for a window unit as defined in claim 1 in which said lock assembly comprises, (a) a horizontal passageway extending longitudinally within said lock assembly housing, (b) there being an opening in the upper portion of said lock assembly housing in vertical alignment with one end of said horizontal passageway for slidably receiving said locking member, (c) an elongated member within and extending longitudinally of said horizontal passageway with one end of said elongated member pivotally connected to said lock assembly housing and the other end thereof operatively connected to said lower portion of said locking member, and (d) a laterally extending passageway through said lock assembly housing for receiving said release element and permitting movement thereof selectively in a first direction to move said portion of said release element in an upward direction to thus move said elongated member and said locking member toward said unlocked position and in a second direction to move said portion of said release element in a downward direction to permit said elongated member and said locking member to move downwardly toward said locked position.

5. A safety lock for a window unit as defined in claim 4 in which said release element is a rotatable key-like member which is adapted to extend through said laterally extending passageway and selectively engage and disengage said elongated member in response to rotation of said key-like member in said first and said second directions, respectively.

6. A safety lock for a window unit as defined in claim 5 in which said key-like member comprises, (a) a generally L-shaped member having one leg thereof adapted to extend through said laterally extending passageway, and (b) a lug projecting laterally from said one leg.

7. A safety lock for a window unit as defined in claim 4 in which said resilient means is a spring-like member.

8. A safety lock for a window unit as defined in claim 7 in which said spring-like member is interposed between said locking member and an adjacent portion of said horizontal passageway.

9. A safety lock for a window unit as defined in claim 4 in which said stop means comprises a threaded stop member in engagement with a threaded opening in said upper portion of said lock assembly housing with said threaded opening being vertically aligned with said horizontal passageway so that upon rotation of said stop member in one direction it engages said elongated member and positively limits upward movement of said locking member while in said locked position.

10. A safety lock for a window unit as defined in claim 1 in which said one end of said horizontal connector arm is mounted for rectilinear movement relative to said lower portion of said latch assembly housing to permit movement of said connector arm selectively to a first position beneath said latch assembly housing with said sash in said closed position and to a second position with said connector arm extending outwardly from said latch assembly housing in response to movement of said sash to said limited open position.

11. A safety lock for a window unit as defined in claim 10 in which an elongated, horizontally extending cavity is provided in said latch assembly housing in vertical alignment with an elongated slot in said lower portion of said latch assembly housing in position to slidably receive said guide member carried by said one end of said horizontal connector arm.

12. A safety lock for a window unit as defined in claim 11 in which said guide member comprises an elongated, vertically extending pin-like member extending upwardly from said one end of said connector arm into said cavity and a roller is mounted for rotation on an upper portion of said pin-like member.

13. A safety lock for a window unit as defined in claim 12 in which restrainer means is mounted within said elongated, horizontally extending cavity in position to engage said roller in response to movement of said connector arm to said first and second positions.

14. A safety lock for a window unit as defined in claim 13 in which said restrainer means comprises an elongated resilient member which extends the full length of said cavity and projects into the path of travel of said roller to restrain movement thereof.

* * * * *